US005679489A

United States Patent [19]

Mukudai et al.

[11] Patent Number: 5,679,489

[45] Date of Patent: Oct. 21, 1997

[54] ELECTROSTATIC IMAGE DEVELOPING TONER

[75] Inventors: Osamu Mukudai; Yuuji Matsuura; Isao Niimura; Kayoko Watanabe; Keiko Iwasa, all of Ibaraki, Japan

[73] Assignee: Hodogaya Chemical Co., Ltd., Tokyo, Japan

[21] Appl. No.: 620,150

[22] Filed: Mar. 22, 1996

Related U.S. Application Data

[63] Continuation of Ser. No. 224,523, Apr. 7, 1994, abandoned.

[30] Foreign Application Priority Data

Nov. 1, 1993 [JP] Japan ..... 5-293799

[51] Int. Cl.[6] ..... G03G 9/097

[52] U.S. Cl. ..... 430/110; 430/904

[58] Field of Search ..... 430/110, 904

[56] References Cited

U.S. PATENT DOCUMENTS

| | | | |
|---|---|---|---|
| 3,853,778 | 12/1974 | Buckley et al. | 430/109 |
| 4,314,013 | 2/1982 | Chang | 430/901 |
| 5,318,883 | 6/1994 | Yamanaka et al. | 430/110 |

FOREIGN PATENT DOCUMENTS

| | | | |
|---|---|---|---|
| 0 385 580 | 9/1990 | European Pat. Off. . | |
| 0 514 867 | 11/1992 | European Pat. Off. . | |
| 0 529 509 | 3/1993 | European Pat. Off. . | |
| 63-250662 | 10/1988 | Japan | 430/108 |
| 3-237467 | 10/1991 | Japan | 430/110 |
| 5 119534 | 5/1993 | Japan . | |
| 5 119535 | 5/1993 | Japan . | |
| 5 119536 | 5/1993 | Japan . | |

OTHER PUBLICATIONS

Patent Abstracts of Japan, vol. 17, No. 107 (P–1496), Mar. 4, 1993, JP–A–04–295 862, Oct. 20, 1992.

Patent Abstracts of Japan, vol. 17, No. 485 (P–1605), Sep. 2, 1993 & JP–A–05 119 534, May 18, 1993.

*Primary Examiner*—Christopher D. Rodee

*Attorney, Agent, or Firm*—Oblon, Spivak, McClelland, Maier & Neustadt, P.C.

[57] ABSTRACT

The present invention provides an electrophotographic toner free of metal such as chromium. A novel electrostatic image developing toner is provided, comprising as a charge-controlling agent one or more selected from the group consisting of compounds represented by formulae (I) and (II):

(I)

(II)

wherein A, B and R are as defined in the specification.

4 Claims, No Drawings

ELECTROSTATIC IMAGE DEVELOPING TONER

This application is a CONTINUATION of application Ser. No. 08/224,523, filed on Apr. 7, 1994, now abandoned.

FIELD OF THE INVENTION

The present invention relates to an electrostatic image developing toner comprising a specific compound.

BACKGROUND OF THE INVENTION

In the electrophotographic image formation process, an electrostatic latent image is formed on an inorganic photoreceptor such as selenium, selenium alloy, cadmium sulfide and amorphous silicon or an organic photoreceptor comprising a charge-generating agent and a charge-transporting agent. The electrostatic latent image thus formed is developed with a toner, transferred to a paper or plastic film, and then fixed to obtain a visible image.

Photoreceptors can be charged positively or negatively depending on their configuration. Photoreceptors which allow a printed area to be left as an electrostatic latent image are developed with an oppositely-chargeable toner while those which allow a printed area to be destaticized to effect reversal development are developed with a toner chargeable to the same sign as the printed area.

A toner comprises a binder resin, a colorant, and other additives. In order to have desirable friction chargeability (charging rate, charging level, charging stability, etc.), age stability and environmental stability, the toner normally comprises a charge-controlling agent incorporated therein. This charge-controlling agent has a great effect on the properties of the toner.

A color toner requires a charge-controlling agent having a light-colored, preferably colorless charge-controlling agent that has no effect on the hue of the image. Examples of such a light-colored or colorless charge-controlling agent employable in negatively-chargeable toners include metal complex salts of hydroxybenzoic acid derivatives as disclosed in JP-B-55-42752 (The term "JP-B" as used herein means an "examined Japanese patent publication"), JP-A-61-69073, and JP-A-61-221756 (The term "JP-A" as used herein means an "unexamined published Japanese patent application"), metallic salts of aromatic dicarboxylic acids as disclosed in JP-A-57-111541, metal complex salts of anthranilic acid derivatives as disclosed in JP-A-61-141453, and JP-A-62-94856, organic boron compounds as disclosed in U.S Pat. No. 4,767,688, and JP-A-1-306861, and biphenol compounds as disclosed in JP-A-61-3149. Examples of such a charge-controlling agent for positively-chargeable toners include quaternary ammonium salt compounds as disclosed in JP-A-57-119364, JP-A-58-9154, and JP-A-58-98742.

However, these charge-controlling agents have many disadvantages. For example, some of these charge-controlling agents are chromium compounds which are liable to cause environmental pollution. Some other charge-controlling agents cannot fully become colorless. These charge-controlling agents exert insufficient effect of providing electric charge. Most of these charge-controlling agents can be used only for oppositely-chargeable toners. Further, these charge-controlling agents exhibit a poor dispersibility and insufficient stability. Thus, none of these charge-controlling agents exhibits sufficient properties.

SUMMARY OF THE INVENTION

It is an object of the present invention to provide a toner which exhibits no deterioration during its preparation, an excellent stability in the form of toner compound, an excellent dispersibility in a binder resin, and an excellent friction chargeability under various environmental conditions and thus provides an invariably high quality image.

The foregoing object of the present invention will become more apparent from the following detailed description and examples.

The inventors have found a colorless stable compound which exhibits an excellent dispersibility in a binder resin and can provide a toner with an excellent chargeability. By using this compound as a charge-controlling agent, the inventors have invented an excellent toner.

In some detail, the present invention relates to an electrostatic image developing toner, comprising as a charge-controlling agent one or more selected from the group consisting of compounds represented by the following general formulae (I) and (II):

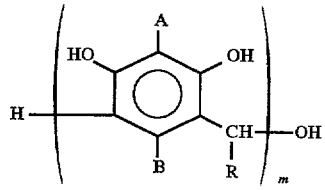

(I)

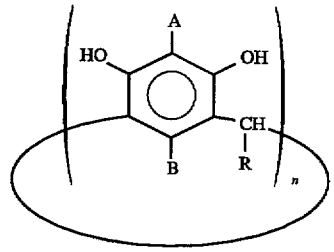

(II)

wherein A and B each independently represent a hydrogen atom, a halogen atom, an alkoxyl group, a carboxyl group, a hydroxyl group, an ester group, a nitro group, an amino group, an alkylamino group, an alkyl group which may contain a substituent(s), or a phenyl group which may contain a substituent(s); R represents a hydrogen atom, an alkyl group which may contain a substituent(s), a phenyl group which may contain a substituent(s), or a naphthyl group which may contain a substituent(s); m represents an integer 2 to 16; and n represents an integer 4 to 8.

DETAILED DESCRIPTION OF THE INVENTION

The electrostatic image developing toner essentially comprises a binder resin, a colorant, and a compound represented by the general formula (I) or (II) according to the present invention. Examples of the process for the preparation of the toner according to the present invention include a process which comprises kneading these materials with the binder resin being molten in a heat-mixer, cooling the mixture, coarse-grinding the mixture, finely grinding the grains, and then classifying the fine grains, a process which comprises dissolving these materials in a solvent, spraying the solution to make finely divided grains, drying the grains, and then classifying the grains, and a process which comprises dispersing a colorant and a charge-controlling agent represented by the general formula (I) or (II) in a suspension comprising droplets of monomers for constituting a binder resin, and then subjecting the dispersion to polymerization.

The amount of the charge-controlling agent is generally from 0.1 to 7% by weight, preferably from 0.3 to 5% by weight, based on the toner. When the toner is used as a single component development, the amount of the binder resin is generally from 30 to 70% by weight based on the toner, and when it is used as a two component development, the amount of the binder resin is generally from 80 to 95% by weight based on the toner. The amount of the colorant is generally from 1 to 10% by weight, preferably from 2 to 7% by weight, based on the toner.

The average particle size of the toner is preferably from 4 to 15 μm.

Examples of the binder resin include polystyrene, styrene-methacrylic ester copolymer, styrene-propylene copolymer, styrene-butadiene copolymer, acrylic resin, styrene-maleic acid copolymer, olefinic resin, polyester, epoxy resin, polyurethane resin, and polyvinyl butyral resin. These binder resins may be used singly or in admixture.

With reference to colorant, carbon black is normally used for black toners. For color toners, there can be used the following known colorants. The term "C.I." as used below is the abbreviation of "Colour Index".

Examples of yellow colorants include azo organic pigments such as C. I. pigment yellow 1, C. I. pigment yellow 5, C. I. pigment yellow 12 and C. I. pigment yellow 17, inorganic pigments such as ocher, and oil-soluble dyes such as C. I. solvent yellow 2, C. I. solvent yellow 6, C. I. solvent yellow 14 and C. I. solvent yellow 19.

Examples of magenta colorants include azo pigments such as C. I. pigment red 57, xanthene pigments such as C. I. pigment violet 1 and C. I. pigment red 81, thioindigo pigments such as C. I. pigment red 87, C. I. vat red 1 and C. I. pigment violet 38, and oil-soluble dyes such as C. I. solvent red 19, C. I. solvent red 49 and C. I. solvent red 52.

Examples of cyan colorants include triphenylmethane pigments such as C. I. pigment blue 1, phthalocyanine pigments such as C. I. pigment blue 15 and C. I. pigment blue 16, and oil-soluble dyes such as C. I. solvent blue 25, C. I. solvent blue 40 and C. I. solvent blue 70.

The compounds represented by formula (I) or (II) are explained in more detail below.

The alkoxyl group of A or B is preferably an alkoxyl group having 1 to 12 carbon atoms, the ester group of A or B is preferably an ester group represented by —COOX wherein X is an alkyl group having 1 to 12 carbon atoms or a phenyl group which may contain a substituent(s) (such as an alkyl group having 1 to 12 carbon atoms, an acetyl group, an amino group, a nitro group, a hydroxyl group, a halogen atom, an alkoxyl group having 1 to 8 carbon atoms, an acethylamino group, or an alkylamino group), the alkylamino group of A or B is preferably an alkylamino group having 1 to 8 carbon atoms, and the alkyl group which may contain a substituent(s) of A or B is preferably an alkyl group having 1 to 12 carbon atoms which may contain a substituent (s).

Examples of the substituent for the alkyl group of A or B include a phenyl group, an acetyl group, an amino group, a nitro group, a hydroxyl group, a halogen atom, and an alkoxyl group having 1 to 8 carbon atoms. Examples of the substituent for the phenyl group of A or B include an alkyl group having 1 to 12 carbon atoms, an acetyl group, an amino group, a nitro group, a hydroxyl group, a halogen atom, an alkoxyl group having 1 to 8 carbon atoms, and an acethylamino group.

The alkyl group which may contain a substituent(s) of R is preferably an alkyl group having 1 to 16 carbon atoms which may contain a substituent(s).

Examples of the substituent for the alkyl group of R include an alkoxyl group having 1 to 8 carbon atoms, a hydroxyl group, a residue of a heterocyclic group having a nitrogen atom or an oxygen atom, and a halogen atom. Examples of the substituent for the phenyl group of R include an alkoxyl group having 1 to 8 carbon atoms, an alkyl group having 1 to 8 carbon atoms, an acetyl group, a hydroxyl group, a carboxyl group, a nitro group, an alkylamino group having having 1 to 8 carbon atoms, an amino group, and a halogen atom. Examples of the substituent for the naphthyl group of R include a hydroxyl group, a carboxyl group, a nitro group, an alkyl group having 1 to 8 carbon atoms, a carbamoyl group, and a halogen atom.

The compounds represented by formula (I) or (II) can be prepared easily according to known methods.

Specific examples of compounds of the present invention which can be used as charge-controlling agents include the following compounds:

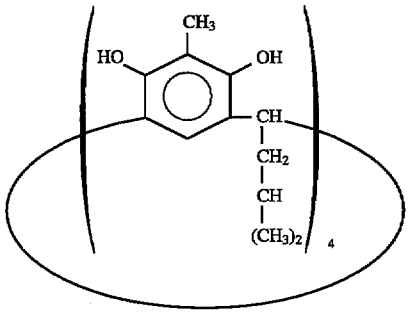

Compound No. (1)

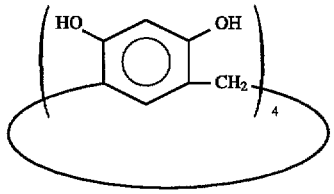

Compound No. (2)

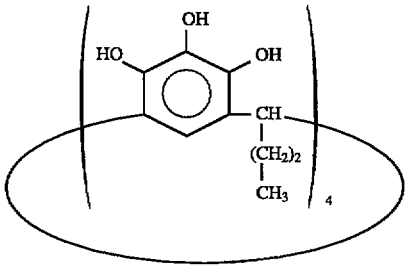

Compound No. (3)

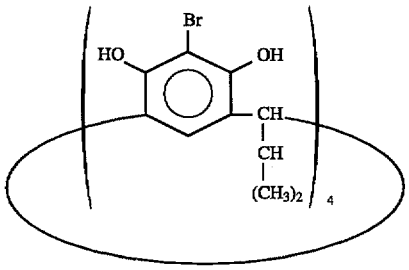

Compound No. (4)

-continued
Compound No. (5)
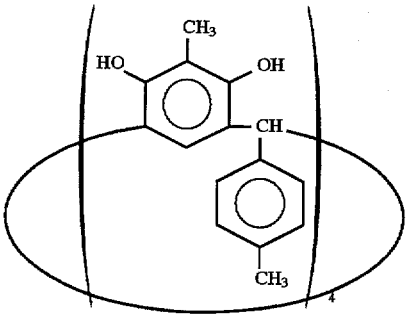
Compound No. (6)
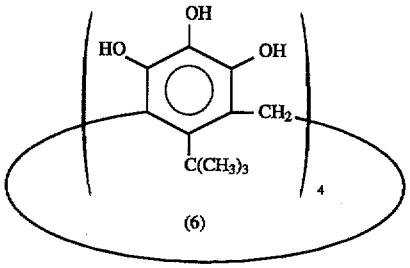
(6)
Compound No. (7)
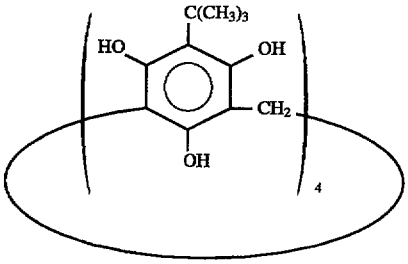
Compound No. (8)
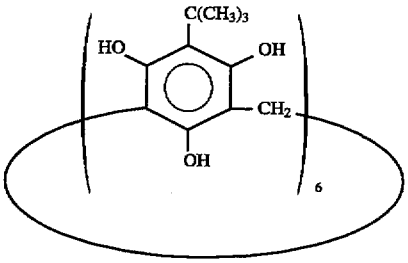
Compound No. (9)
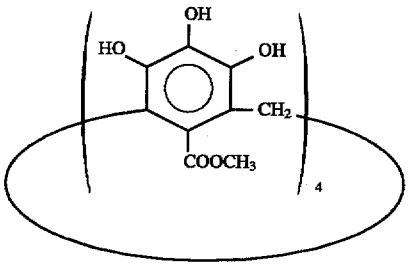
Compound No. (10)
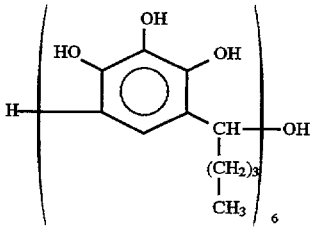
-continued
Compound No. (11)
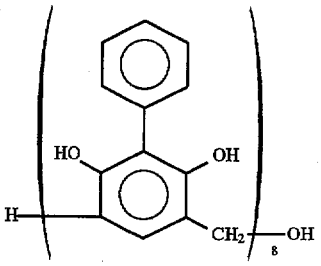
Compound No. (12)
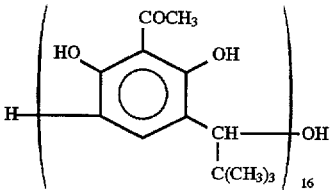
Compound No. (13)
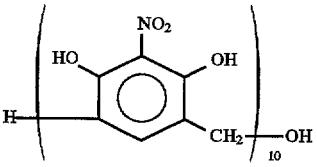
Compound No. (14)
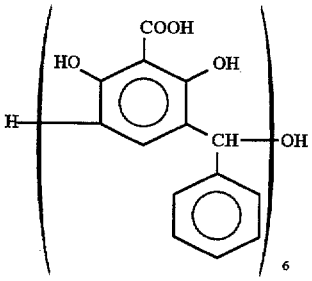
Compound No. (15)
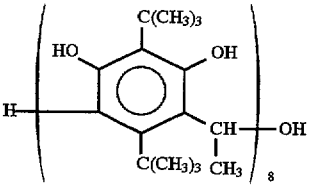
Compound No. (16)
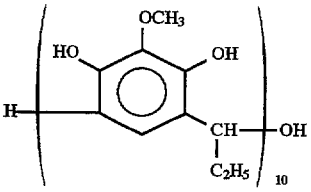
Compound No. (17)
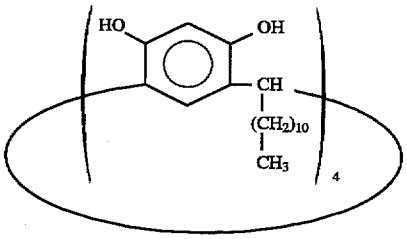

-continued

Compound No. (18)

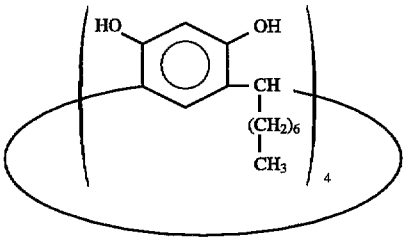

Compound No. (19)

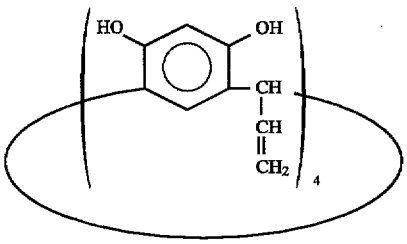

Compound No. (20)

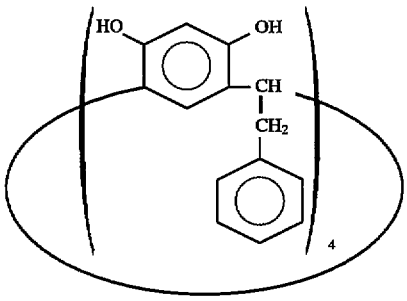

Compound No. (21)

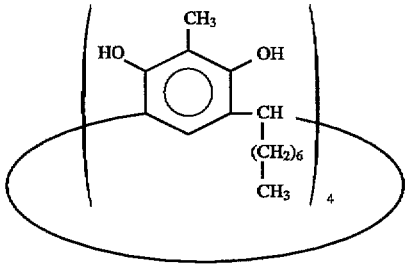

Compound No. (22)

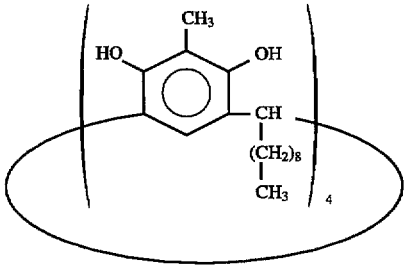

-continued

Compound No. (23)

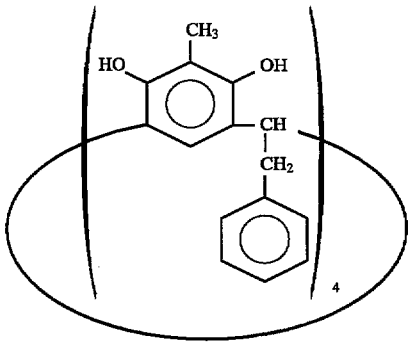

The toner of the present invention may comprise a hydrophobic silica, metallic soap, fluorinic surface active agent, dioctyl phthalate, wax, tin oxide, electrically conductive zinc oxide, etc. incorporated therein as additives for the purpose of protecting photoreceptor and carrier, enhancing the fluidity and fixability of the toner, controlling the thermal, electrical and physical properties, resistance and softening point or like purposes.

If the toner according to the present invention is incorporated in a two component development, a binder type carrier comprising minute glass beads, iron powder, ferrite powder or magnetic grains dispersed therein or resin-coated carrier comprising a polyester resin, fluoride resin, acrylic resin, silicon resin or the like coated on the surface thereof may be used as a carrier. The mixing ratio by weight of the toner of the present invention to the carrier is generally between 2/98 and 10/90.

Further, the toner according to the present invention can also exhibit excellent properties as a unitary toner (single component development).

The present invention will be further described in the following examples, but the present invention should not be construed as being limited thereto. The term "parts" as used herein means "parts by weight".

EXAMPLE 1

One part of Compound No. (1), 5 parts of carbon black and 94 parts of a styrene-ethylhexyl methacrylate copolymer were kneaded in a heat-mixer at 110° to 150° C., cooled, and then subjected to coarse grinding in a hammer mill. The coarse grains were subjected to fine grinding in a jet mill, and then classified to obtain a black toner having a size of 10 to 12 μm. The toner thus obtained was mixed with an iron powder carrier in a weight ratio of 4:100, and then shaken. As a result, the toner was negatively charged. The toner was measured for charge by means of a blow-off powder charge meter (manufactured by Toshiba Chemical Co., Ltd.). The result was −21 μc/g. With this toner, an image was reproduced by means of a remodelled commercial duplicating machine. As a result, a sharp image could be obtained at the initial stage as well as after duplicating 10,000 sheets.

EXAMPLE 2

One part of Compound No. (12), 5 parts of carbon black and 94 parts of a styrene-ethylhexyl methacrylate copolymer were kneaded in a heat-mixer at 110° to 150° C., cooled, and then subjected to coarse grinding in a hammer mill. The coarse grains were subjected to fine grinding in a jet mill, and then classified to obtain a black toner having a size of 10 to 12 μm. The toner thus obtained was mixed with an iron powder carrier in a weight ratio of 4:100, and then shaken. As a result, the toner was negatively charged. The toner was measured for charge by means of a blow-off powder charge meter. The result was −18 μc/g. With this toner, an image was reproduced by means of a remodelled commercial duplicating machine. As a result, a sharp image could be obtained at the initial stage as well as after duplicating 10,000 sheets.

EXAMPLE 3

One part of Compound No. (1), 5 parts of Spilon Blue 2BNH (available from Hodogaya Chemical Co., Ltd.) as a copper phthalocyanine oil-soluble dye and 94 parts of a styrene-butyl methacrylate copolymer were kneaded in a heat-mixer at 110° to 150° C., cooled, and then subjected to coarse grinding in a hammer mill. The coarse grains were subjected to fine grinding in a jet mill, and then classified to obtain a blue toner having a size of 10 to 12 μm. The toner thus obtained was mixed with an iron powder carrier in a weight ratio of 4:100, and then shaken. As a result, the toner was negatively charged. The toner was measured for charge by means of a blow-off powder charge meter. The result was −23 μc/g. With this toner, an image was reproduced by means of a remodelled commercial duplicating machine. As a result, a sharp image could be obtained at the initial stage as well as after duplicating 10,000 sheets.

EXAMPLE 4

One part of Compound No. (1), 5 parts of carbon black and 94 parts of a styrene-ethylhexyl methacrylate copolymer were kneaded in a heat-mixer at 110° to 150° C., cooled, and then subjected to coarse grinding in a hammer mill. The coarse grains were subjected to fine grinding in a jet mill, and then classified to obtain a black toner having a size of 10 to 12 μm. The toner thus obtained was mixed with a silicon coating carrier in a weight ratio of 4:100, and then shaken. As a result, the toner was negatively charged. The toner was measured for charge by means of a blow-off powder charge meter. The result was −14 μc/g. With this toner, an image was reproduced by means of a remodelled commercial duplicating machine. As a result, a sharp image could be obtained at the initial stage as well as after duplicating 10,000 sheets.

EXAMPLE 5

One part of Compound No. (14), 5 parts of carbon black and 94 parts of a styrene-ethylhexyl methacrylate copolymer were kneaded in a heat-mixer at 110° to 150° C., cooled, and then subjected to coarse grinding in a hammer mill. The coarse grains were subjected to fine grinding in a jet mill, and then classified to obtain a black toner having a size of 10 to 12 μm. The toner thus obtained was mixed with an acryl coating carrier in a weight ratio of 4:100, and then shaken. As a result, the toner was negatively charged. The toner was measured for charge by means of a blow-off powder charge meter. The result was −18 μc/g. With this toner, an image was reproduced by means of a remodelled commercial duplicating machine. As a result, a sharp image could be obtained at the initial stage as well as after duplicating 10,000 sheets.

EXAMPLE 6

One part of Compound No. (11), 60 parts of magnetic iron powder and 100 parts of a styrene-acryl copolymer were kneaded in a heat-mixer at 110° to 150° C., cooled, and then subjected to coarse grinding in a hammer mill. The coarse grains were subjected to fine grinding in a jet mill, and then classified to obtain a black toner having a size of 10 to 12 μm. With this unitary toner, an image was reproduced by means of a remodelled commercial duplicating machine. As a result, a sharp image could be obtained at the initial stage as well as after duplicating 10,000 sheets.

EXAMPLES 7 to 22

Toners were prepared in the same manner as in Example 1 except that compounds as set forth in Table 1 were used instead of Compound No. (1). The results are set forth in Table 1.

TABLE 1

| Example | Compound | Toner charge (−μ/g) | Image quality: Initial stage | Image quality: After 10,000 sheets |
|---|---|---|---|---|
| 7 | Compound No. (2) | 13 | Sharp | Sharp |
| 8 | Compound No. (3) | 16 | Sharp | Sharp |
| 9 | Compound No. (5) | 21 | Sharp | Sharp |
| 10 | Compound No. (6) | 22 | Sharp | Sharp |
| 11 | Compound No. (8) | 23 | Sharp | Sharp |
| 12 | Compound No. (9) | 14 | Sharp | Sharp |
| 13 | Compound No. (10) | 17 | Sharp | Sharp |
| 14 | Compound No. (16) | 18 | Sharp | Sharp |
| 15 | Compound No. (15) | 17 | Sharp | Sharp |
| 16 | Compound No. (17) | 19 | Sharp | Sharp |
| 17 | Compound No. (18) | 17 | Sharp | Sharp |
| 18 | Compound No. (19) | 14 | Sharp | Sharp |
| 19 | Compound No. (20) | 15 | Sharp | Sharp |
| 20 | Compound No. (21) | 23 | Sharp | Sharp |
| 21 | Compound No. (22) | 25 | Sharp | Sharp |
| 22 | Compound No. (23) | 17 | Sharp | Sharp |

The toner comprising a compound according to the present invention as a charge-controlling agent exhibits an excellent environmental resistance and age stability. As a result, a high quality electrostatic image developing toner which causes no duplicating stain or other troubles is provided. Further, since the charge-controlling agent is white or substantially colorless itself and hence has no effect on the saturation of the colorant, an arbitrary colorant can be selected depending on the hue necessary for color toner, by no means impairing the characteristic hue of dyes and pigments.

While the invention has been described in detail and with reference to specific embodiments thereof, it will be apparent to one skilled in the art that various changes and modifications can be made therein without departing from the spirit and scope thereof.

What is claimed is:

1. An electrostatic image developing toner comprising a binder resin, a colorant and at least one charge-controlling agent of formula (I) or (II):

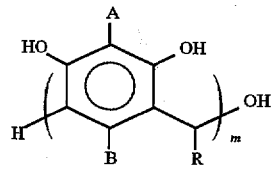

(I)

-continued (II)

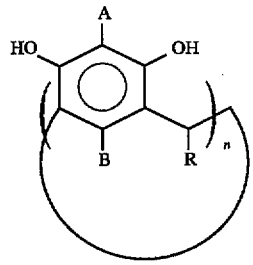

wherein A and B each independently represents:

a hydrogen atom, a halogen atom, a $C_{1-12}$ alkoxy group, a carboxyl group, a hydroxyl group, an ester group represented by —COOX wherein X is a $C_{1-12}$ alkyl group, a phenyl group or a substituted phenyl group having at least one substituent selected from the group consisting of a $C_{1-12}$ alkyl group, an acetyl group, an amino group, a nitro group, a hydroxyl group, a halogen atom, a $C_{1-8}$ alkoxy group, an acetylamino group and an alkylamino group, a nitro group, an amino group, a $C_{1-8}$ alkylamino group, a $C_{1-12}$ alkyl group, a substituted $C_{1-12}$ alkyl group have at least one substituent selected from the group consisting of a phenyl group, an acetyl group, an amino group, a nitro group, a hydroxyl group, a halogen atom, and a $C_{1-8}$ alkoxyl group, a phenyl group, or a substituted phenyl group having at least one substituent selected from the group consisting of a $C_{1-12}$ alkyl group, an acetyl group, an amino group, a nitro group, a hydroxyl group, a halogen atom, a $C_{1-8}$ alkoxy group, and an acetylamino group;

R represents a $C_{3-16}$ alkyl group, a substituted $C_{1-16}$ alkyl group having at least one substituent selected from the group consisting of a $C_{1-8}$ alkoxy group, a hydroxyl group, a residue of a heterocyclic group having a nitrogen atom or an oxygen atom, and a halogen atom, a phenyl group, a substituted phenyl group having at least one substituent selected from the group consisting of a $C_{1-8}$ alkoxyl group, a $C_{1-8}$ alkyl group, an acetyl group, a hydroxyl group, a carboxyl group, a nitro group, a $C_{1-8}$ alkylamino group, an amino group, and a halogen atom, a naphthyl group, or a substituted naphthyl group having at least one substituent selected from the group consisting of a hydroxyl group, a carboxyl group, a nitro group, a $C_{1-8}$ alkyl group, a carbamoyl group, and a halogen atom;

m represents an integer 2 to 16; and n represents an integer 4 to 8.

2. The electrostatic image developing toner according to claim 1, wherein said charge-controlling agent represented by formula (I) or (II) is present in an amount of 0.1 to 7% by weight based on the toner.

3. The electrostatic image developing toner of claim 1, wherein said charge-controlling agent is selected from the group consisting of:

(1)

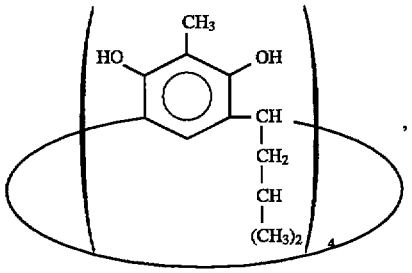

(3)

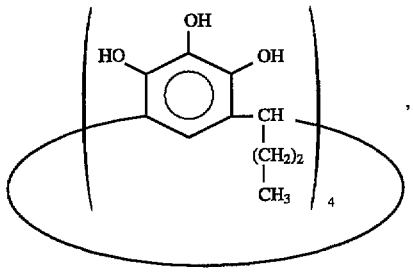

(4)

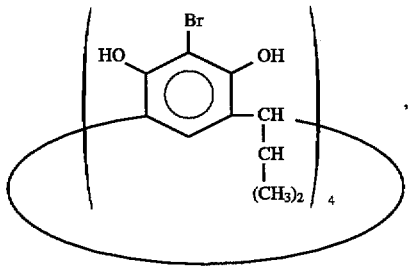

(5)

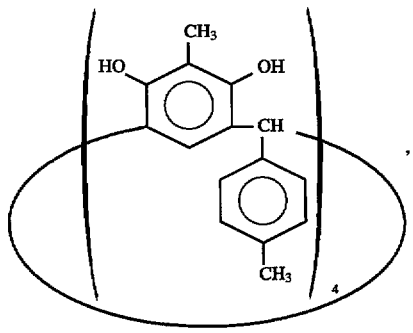

(10)

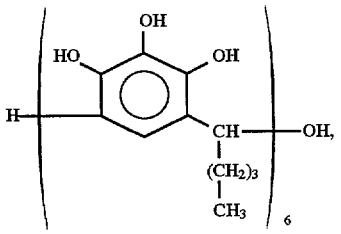

-continued
(12)
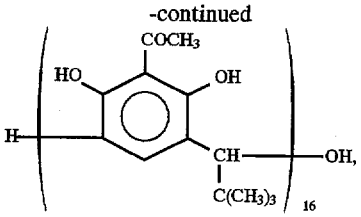
(14)
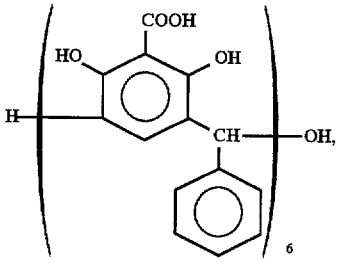
(17)
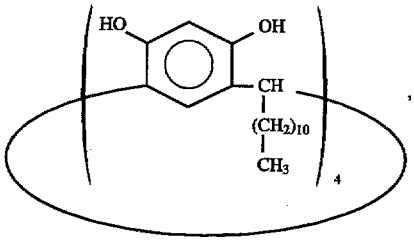
(18)
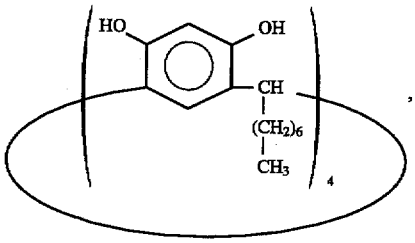
(21)
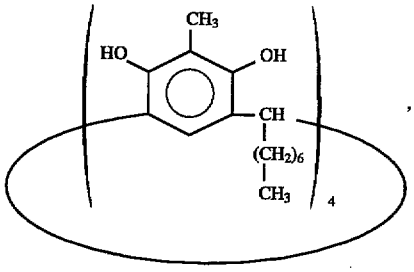
, and
(22)
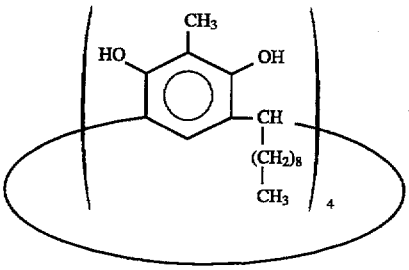
4. An electrostatic image developing toner comprising a binder resin, a colorant and a charge-controlling agent of a formula selected from the group consisting of
(19)
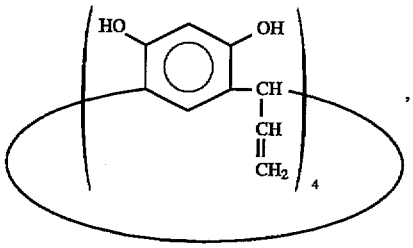
(20)
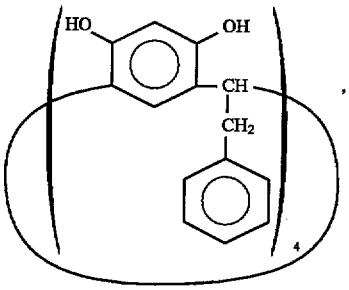
and
(23)
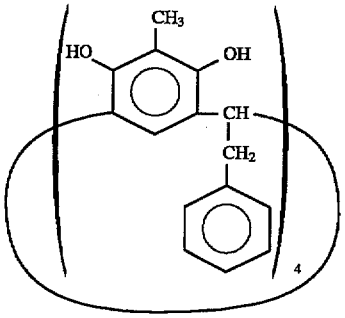
* * * * *